United States Patent [19]

Hartjens et al.

[11] 4,043,902

[45] Aug. 23, 1977

[54] TRI-CARBOXYLATED AND TETRA-CARBOXYLATED FATTY ACID ASPARTATES AS FLOTATION COLLECTORS

[75] Inventors: Hermen Hartjens, Sun City, Ariz.; Arnold Day, Wilton, Conn.

[73] Assignee: American Cyanamid Company, Stamford, Conn.

[21] Appl. No.: 584,545

[22] Filed: June 6, 1975

[51] Int. Cl.[2] ..... B03D 1/02

[52] U.S. Cl. ..... 209/166

[58] Field of Search ..... 209/166, 167

[56] References Cited

U.S. PATENT DOCUMENTS

| | | | |
|---|---|---|---|
| 1,952,907 | 3/1934 | Christinann | 209/166 |
| 2,414,199 | 1/1947 | Butzeit | 209/166 |
| 2,740,522 | 4/1956 | Aimone | 209/166 |
| 3,469,693 | 9/1969 | Arbiter | 209/106 |
| 3,572,504 | 3/1971 | DeCuyper | 209/166 |
| 3,779,380 | 12/1973 | Bishop | 209/166 |
| 3,830,366 | 8/1974 | Day | 209/166 |

*Primary Examiner*—Robert Halper

*Attorney, Agent, or Firm*—Charles J. Fickey

[57] ABSTRACT

A process for beneficiating non-sulfide minerals such as celestite, barite, scheelite, fluorite, calcite, magnesite, gypsum, anhydrite, cassiterite, apatite and the like comprising froth floating a pulp conditioned with gangue depressant, where necessary, and using salts of tri- and tetra- carboxyl containing fatty alkyl substituted aspartic acids, aspartic mono-esters, and aspartic di-esters.

17 Claims, No Drawings

TRI-CARBOXYLATED AND TETRA-CARBOXYLATED FATTY ACID ASPARTATES AS FLOTATION COLLECTORS

This invention relates to an improved process for flotation of certain ores. More particularly, this invention relates to an improved process for froth flotation of non-sulfide ores such as sulfates, carbonates, fluorides, tungstates, phosphates and oxides, e.g., celestite, barite, sheelite, fluorite, calcite, magnesite, gypsum, anhydrite, cassiterite, apatite and the like, using salts of tri- and tetra- carboxyl containing fatty alkyl substituted aspartic acids, aspartic mono-esters, and aspartic di-esters, as collectors in conjunction with appropriate gangue depressants where required.

In the past, these ores were beneficiated by flotation procedures using various combinations of chemicals in such beneficiation In some instances, for example, froth flotation was employed using fatty acids, saturated alcohols and petroleum sulfonates alone as collecting agents, in conjunction with modifying agents such as sodium silicate and sodium carbonate. Although the beneficiation procedures currently employed are effective, there nevertheless continues to exist the need for new processes which can provide greater selectivity and higher recovery of the desired ore components while at the same time reducing chemical requirements and lowering costs of recovery.

In U.S. Pat. No. 3,469,693, Sept. 30, 1969, Arbiter, there is disclosed a process for beneficiating certain ores in which the desired values are present as oxides and sulfides. The process involves use of N-alkylsulfosuccinamates as collectors without the need for depressants in beneficiating specific ores. The process requires desliming of the ores treated prior to beneficiation and operates under acidic conditions. Disodium N-octadecylsulfosuccinamate is noted to be more selective in the ore beneficiation process than is tetrasodium N-(1,2-dicarboxyethyl)-N-octadecylsulfosuccinamate. Thus, the nature of the ore processed is such as to have particular requirements with respect to collector, depressants and conditions of use.

In accordance with U.S. Pat. No. 3,830,366 there is disclosed a process for beneficiating an ore selected from the group consisting of celestite, barite, scheelite, fluorite, calcite, magnesite, gypsum, anhydrite, and apatite, which process comprises grinding said ore to flotation size, pulping the ground ore, conditioning the pulp with an effective amount of a depressant for gangue minerals, subjecting the conditioned pulp to froth flotation with tetrasodium N-(1,2-dicarboxyethyl)-N-octadecylsulfosuccinamate.

In the present invention, a collector is used which is a compound from the group, salts of tri- and tetra- carboxyl containing fatty alkyl substituted aspartic acids, aspartic mono-esters, and aspartic di-esters, namely, trivalent salts of N-(3-carboxyacryloyl)-N-octedecyl aspartic acid of the formula

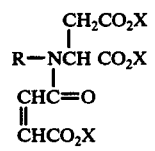

and tetravalent salts of N-[3-(3-carboxy-N-octadecylacrylamido)propyl]-N-(3-carboxyacryloyl)aspartic acid of the formula

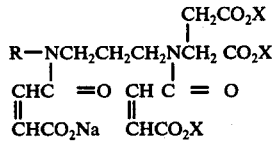

where R is a long chain alkyl group containing 12 to 22 carbon atoms and X is sodium, potassium or ammonium, and the mono or di alkyl exters thereof, where the alkyl group contains from 1 to 13 carbon atoms, preferably from 1 to 8 carbon atoms. The aspartates are used in an amount of typically from about 0.15 to 0.3 pounds per ton of ore.

The process of the present invention provides increased selectivity and increased recovery of the desired ore over former processes and decreases the requirement for chemicals in processing. The present process operates with ores which exhibit ionic nature in the presence of water, as well as oxides, employs a collector, and a depressant where required, and makes use of a tri- or tetra- carboxylated aspartate.

In carrying out the process of the present invention, the ore employed is a non-sulfide ore such as celestite, barite, scheelite, fluorite, calcite, magnesite, gypsum, anhydrite, cassiterite and apatite. Gypsum and anhydrite merely differ in water content but otherwise represent the same material content. Apatite refers generally to phosphate rocks containing minerals in the apatite group. The ore selected is ground to a size suitable for froth flotation. Typically, the size of the grind is such that a large portion will pass through a 200 or 325 mesh screen. The present invention, being a froth flotation process, makes use of a grind conventionally prepared for froth flotation employing an ore as specified.

After the conventional grind has been obtained, it is pulped in water in accordance with conventional froth flotation procedures. Conveniently, the grind is pulped directly in the flotation cell used to carry out conventional froth flotations. The nature of the pulp should be the same as is customarily processed except for additives used in processing.

After the grind is pulped, the pulp may be conditioned with suitable gangue depressant if necessary so as to obtain a satisfactory dispersion and effectively depress gangue minerals. The type and quantity of depressant will vary depending on the specific ore being processed as well known in the art, and the depressant is not a novel feature of this invention. The depressant may be, for example, in the case of celestite, barite, scheelite, calcite, and magnesite, sodium silicate, at a concentration of about 0.5 to 5 pounds per ton of ore. In the case of fluorite, gypsum and anhydrite, quebracho may be used at a concentration of about 0.1 to 1.0 pound per ton of ore. In the case of apatite, NaOH may be used at about 0.5 pound per ton of ore. Sodium carbonate may also be used. The time of conditioning is usually short, i.e., from a fraction of a minute to several minutes, and needs to be only as long as is required to effect satisfactory pulp dispersion.

After the pulp is conditioned, it is subjected to froth flotation employing from about 0.10 to 0.50 pound total per ton of ore of the aspartates preferably from about 0.15 to 0.3 lb./ton of ore. It is generally preferable to add the aspartate in stages, employing short conditioning and flotation steps in each stage.

The aspartates are water-soluble and easy to handle, relatively non-toxic and biodegradable and are thus highly advantageous in the present invention.

The concentrate produced by froth flotation is then collected by suitable procedures normally employed in conjunction with conventional processes. Upon collection, the rough concentrate is frequently of commercial grade and may be processed without additional treatment. It is generally desirable, however, to obtain cleaner concentrates by reflotation of the rougher concentrate. In the reflotation, use may be made of small amounts of collector, depressant, or both depending upon the nature of the rough concentrate initially obtained. Thus, if recovery is lower than desired, small increments of collector are added in each cleaning cycle. If purity is low in the rough concentrate, small increments of depressant are added in each cleaning. If both purity and recovery need improvement, both collector and depressant may be added in small increments. An increment of collector is generally of 0.01–0.02 lb. per ton of original ore. An increment of depressant may be about 0.2 lb. per ton of original ore.

The invention is illustrated by the examples which follow in which temperature of processing is ambient unless otherwise specified.

Trisodium N-(3-carboxyacryloyl)-N-octadecyl aspartate

EXAMPLE 1

Celestite Flotation

Ore assay: 54% $SrSO_4$

Gangue minerals: Calcite, Hematite and Quartz

The ore was ground to 88% minus 325 mesh. The ground ore was placed in a flotation cell and pulped to a consistency satisfactory for flotation. The pulped ore was conditioned for 3 minutes with $Na_2SiO_3$, 5.0 lb. per ton of ore, to obtain a satisfactory pulp dispersion and as a depressant for gangue minerals. Flotation was then effected with staged additions of trisodium N-(3-carboxyacryloyl)-N-octadecyl aspartate in five stages, the first being 0.067 lb. per ton of ore and the last four 0.033 lb. per ton of ore to give a total of 0.2 lb. per ton of collector. Each stage consisted of 0.5 minute of conditioning and 1.0 minute of flotation using a polypropylene glycol type of frother, at a total dosage of 0.072 lb. per ton of ore.

The rougher concentrate obtained was cleaned twice by reflotation using 0.017 lb. per ton of original ore of the collector identified above in each cleaning.

Results are given in the Table below.

TABLE I

| | % $SrSO_4$ | % Distribution of $SrSO_4$ |
|---|---|---|
| Feed (Calculated) | 53.6 | 100.00 |
| Rougher Concentrate | 67.9 | 98.72 |
| Rougher Tailings | 3.1 | 1.28 |
| Twice Cleaned Concentrate | 76.7 | 95.35 |

Tetrasodium N[3-(Carboxy-N-Octadecylacrylamido)Propyl]-N-(3-Carboxyacryloyl)aspartate

EXAMPLE 2

Celestite Flotation

Ore assay: 54% $SrSO_4$

Gangue minerals: Calcite, Hematite and Quartz

This test was conducted in exactly the same manner as the test in Example 1 except tetrasodium N[3-(3-carboxy-N-octadecylacrylamido)propyl]-N-(3-carboxyacryloyl)aspartate was substituted on a pound for pound basis for trisodium N-(3-carboxyacryloyl)-N-octadecyl aspartate.

Results are given in the Table below.

TABLE II

| | % $SrSO_4$ | % Distribution of $SrSO_4$ |
|---|---|---|
| Feed (Calculated) | 54.2 | 100.00 |
| Rougher Concentrate | 69.1 | 98.92 |
| Rougher Tailings | 2.6 | 1.08 |
| Twice Cleaned Concentrate | 77.4 | 95.36 |

Trisodium N-(3-Carboxyacryloyl)-N-Octadecyl aspartate

EXAMPLE 3

Barite Flotation

Ore assay: 73% $BaSO_4$ with calcite and quartz as major gangue minerals

The ore was ground to 94% minus 200 mesh. The ground ore was pulped in a flotation cell to a consistency satisfactory for flotation. The pulp was conditioned with $Na_2SiO_3$, 4.0 lb. per ton of ore, for 3 minutes. The conditioned pulp was floated in four stages using 0.017 lb. per ton of collector from Example 1 in the first stage and 0.033 lb. per ton of collector from Example in the last three stages for a total usage of collector of 0.167 lb. per ton of ore. Each stage involved 0.5 minute of conditioning and 1.0 minute of flotation. Frother was as in Example 1. The rougher concentrate obtained was cleaned twice by reflotation using 0.033 lb. per ton of original ore of the collector from Example 1 in each cleaning stage.

Results are given in the Table below.

TABLE III

| | % $BaSO_4$ | % $BaSO_4$ Recovery |
|---|---|---|
| Rougher concentrate | 86.56 | 97.22 |
| Recleaned concentrate | 90.10 | 95.12 |

Tetrasodium N[3-(3-Carboxy-N-Octadecylacrylamido)Propyl]-N-(3-Carboxyacryloyl)aspartate

EXAMPLE 4

Barite Flotation

Ore assay: 73% $BaSO_4$ with calcite and quartz as the major gangue minerals

This test was conducted in exactly the same manner as the test in Example 3 except tetrasodium N[3-(3-carboxy-N-octadecylacrylamido)propyl]-N-(3-carboxyacryloyl)aspartate was substituted on a pound for pound basis for trisodium N-(3-carboxyacryloyl)-N-octadecyl aspartate.

Results are given in the Table below:

TABLE IV

| | % $BaSO_4$ | % $BaSO_4$ Recovery |
|---|---|---|
| Rougher Concentrate | 86.9 | 97.43 |
| Recleaned Concentrate | 90.7 | 94.88 |

Trisodium N-(3-carboxyacryloyl)-N-octadecyl aspartate

EXAMPLE 5

Fluorite Flotation

Ore assay: 60% $CaF_2$, 31% $CaCO_3$, 5% $SiO_2$, balance silicates

The ore was ground to 52% minus 200 mesh. The ground ore was pulped in a flotation cell to a consistency suitable for flotation. The pulp was conditioned for 10 minutes using $Na_2CO_3$, 0.5 lb. per ton of ore; Quebracho, 0.6 lb. per ton of ore. The conditioned pulp was froth floated in 5 stages using 0.06 lb. per ton of frother described in Example 1. The collector was as in Example 1 at a usage of 0.033 lb. per ton in each stage. Each stage involved 0.5 minute of conditioning and 1.0 minute of flotation, thus involving 0.167 lb. per ton of collector.

The rougher froth was repulped and refloated four times using 0.0167 lb. per ton of the same collector and 0.02 lb. per ton of quebracho in each cleaning.

Results are given in the Table below.

TABLE V

| | % $CaF_2$ | % Distribution of $CaF_2$ |
|---|---|---|
| Feed (Calculated) | 59.81 | 100.00 |
| Rougher Concentrate | 67.57 | 99.11 |
| Rougher Tailing | 4.32 | 0.89 |
| 2nd Cleaning | 86.20 | 93.54 |
| 4th Cleaning | 94.54 | 89.65 |

Tetrasodium N[3-(3-carboxy-N-octadecylacrylamido)propyl]-N-(3-carboxyacryloyl)aspartate

EXAMPLE 6

Fluorite Flotation

Ore assay: 60% $CaF_2$, 31% $CaCO_3$, 5% $SiO_2$, balance silicates

This test was conducted in exactly the same manner as the test in Example 5 except tetrasodium N[3-(3-carboxy-N-octadecylacrylamido)propyl]-N-(3-carboxyacryloyl)aspartate was substituted on a pound for pound basis for trisodium N-(3-carboxyacryloyl)-N-octadecyl aspartate. Results are given in the Table below.

TABLE VI

| | % $CaF_2$ | % Distribution of $CaF_2$ |
|---|---|---|
| Feed (Calculated) | 59.98 | 100.00 |
| Rougher Concentration | 66.89 | 99.55 |
| Rougher Tailing | 2.51 | 0.45 |
| 2nd Cleaning | 88.62 | 93.27 |
| 4th Cleaning | 95.89 | 88.85 |

Trisodium N-(3-carboxyacryloyl)-N-octadecyl aspartate

EXAMPLE 7

Cassiterite Flotation

Ore assay: 0.40% Sn, 67.0% $SiO_2$, 8.0% $Al_2O_3$ with minor iron and sulfide minerals The ore was pulped in a flotation cell to a consistency suitable for flotation. The sulfides were removed by flotation using a suitable sulfide flotation collector. The pulp was subjected to a desliming step to remove the minus 10-micron slime particles which interfere with the cassiterite flotation. The plus 10-micron material was conditioned for 2.0 minutes with 1.2 lb. per ton $H_2SO_4$ to effect a flotation pulp pH of 2.5. Rougher flotation was carried out in three stages using 0.33 lb. per ton of collector of Example 1 in the first stage and 0.083 lb. per ton of the collector in the second and third stages. Each stage consisted of 1.0 minute of conditioning and 3.0 minutes of flotation.

The rougher concentrate obtained was cleaned twice by reflotation using 0.042 lb. per ton of original ore of the collector employed initially in each cleaning.

Results are given in the Table below.

TABLE VII

| | % Sn | % Distribution of $Sn_2$ |
|---|---|---|
| Flotation Feed (calculated) | 0.39 | 100.0 |
| Rougher Concentrate | 0.80 | 90.7 |
| Rougher Tailings | 0.06 | 9.3 |
| Twice Cleaned Concentrate | 4.36 | 79.0 |

Trisodium N-(3-carboxyacryloyl)-N-octadecyl aspartate

EXAMPLE 8

Calcite Flotation

Ore assay: 56% $CaCO_3$ with $SiO_2$ as the principal gangue constituent

The ore was ground to 82% minus 200 mesh, conditioned with 2.0 lb/ton $Na_2SiO_3$ and 1.0 lb/ton $Na_2CO_3$ for three minutes. Flotation was effected in four stages using 0.033 lb/ton of ore of the collector of Example 1 and 0.1 lbs/ton of ore of No. 5 Fuel Oil in each stage, for a total use of collector of 0.133 lb/ton. Each stage consisted of 0.5 minute of conditioning and 1.0 minute flotation. Frother was as in Example 1.

Results are given in the Table below.

TABLE VIII

| | % $CaCO_3$ | % Distribution of $CaCO_3$ |
|---|---|---|
| Flotation Feed | 56.5 | 100.0 |
| Rougher Concentration | 83.6 | 92.0 |

Sodium dioctyl N-(3-carboxyacryloyl)-N-octadecyl aspartate

EXAMPLE 9

Cassiterite Flotation

Ore assay: 0.78% Sn with tourmaline as the major and quartz as the minor gangue constituents The ore was ground to 90% minus 200 mesh and deslimed to remove the minus 10 micron particles. The plus 10 microns material was pulped to suitable consistency with water in a flotation machine and conditioned with $H_2SO_4$ to pH 2.5. Rougher flotation was carried out in five stages by addition of 0.033 lb. of collector per ton of ore in each stage for a total collector addition of 0.167 lb. per ton. The total flotation time was 10 minutes. The rougher concentrate was cleaned three times at pH 2.5 by reflotation using 0.033 lb. of collector per ton of original ore in each cleaning stage.

Results are given in the Table below.

TABLE IX

| | % Sn | % Distribution of Sn |
|---|---|---|
| Flotation Feed | 0.80 | 100.00 |
| Rougher Tailings | 0.08 | 4.95 |
| Combined Cleaner Tailings | 0.55 | 24.30 |
| Final Concentrate | 3.72 | 70.75 |

We claim:

1. A method of beneficiating an ore selected from the group consisting of non-sulfide minerals such as sulfates, carbonates, fluorides, tungstates, phosphates and oxides, which comprises grinding said ore to flotation size, pulping the ground ore in water, and subjecting the pulp to froth flotation with a compound of the group, trivalent salts of the formula:

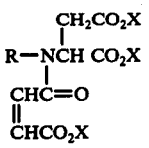

and tetravalent salts of the formula

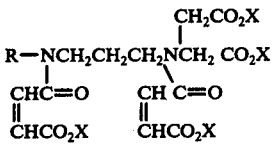

where R is a long chain alkyl group containing 12 to 22 carbon atoms and X is sodium, potassium or ammonium, and the mono or di alkyl esters thereof, where the alkyl group contains from 1 to 13 carbon atoms, preferably from 1 to 8 carbon atoms.

2. The process of claim 1 wherein the pulp is conditioned with an effective amount of a depressant for the gangue material.

3. The process of claim 2 wherein the ores are selected from celestite, barite, scheelite, calcite, cassiterite and magnesite and the depressant is sodium silicate in an amount of about 3 to 5 lbs. per ton.

4. The process of claim 3 wherein the ore is celestite.

5. The process of claim 3 wherein the ore is barite.

6. The process of claim 3 wherein the ore is scheelite.

7. The process of claim 3 wherein the ore is calcite.

8. The process of claim 3 wherein the ore is magnesite.

9. The process of claim 3 wherein the ore is cassiterite.

10. The process of claim 2 wherein the ores are selected from fluorite, gypsum and anhydrite and the depressant is Quebracho in an amount of about 0.1 to 1.0 lb. per ton.

11. The process of claim 10 wherein the ore is fluorite.

12. The process of claim 10 wherein the ore is gypsum.

13. The process of claim 10 wherein the ore is anhydrite.

14. The process of claim 2 wherein the ore is apatite and the depressant is NaOH in an amount of about 0.5 lb. per ton.

15. The process of claim 2 wherein the concentrate obtained is repulped and subjected to further froth flotation with addition of suitable depressant and said aspartates or both.

16. The process of claim 1 wherein the collector is used in the range of 0.15 to 0.3 lb. per ton of ore.

17. The process of claim 1 wherein froth flotation is carried out in stages with partial usage of collector in each stage so as to provide total collector usage in the range of 0.10 to 0.50 lb. per ton of ore.

* * * * *